US009683803B2

(12) United States Patent
Dix et al.

(10) Patent No.: US 9,683,803 B2
(45) Date of Patent: Jun. 20, 2017

(54) TRIPOD MOUNT WITH A TRAVERSE SUPPORT MECHANISM

(71) Applicants: Stephen M. Dix, Fredericksburg, VA (US); Tracy V. White, Dunnsville, VA (US)

(72) Inventors: Stephen M. Dix, Fredericksburg, VA (US); Tracy V. White, Dunnsville, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 15/371,272

(22) Filed: Dec. 7, 2016

(65) Prior Publication Data

US 2017/0082389 A1 Mar. 23, 2017

Related U.S. Application Data

(63) Continuation-in-part of application No. 14/752,707, filed on Jun. 26, 2015, now Pat. No. 9,518,795.

(51) Int. Cl.
*F41A 23/12* (2006.01)
*F41A 27/12* (2006.01)

(52) U.S. Cl.
CPC ..... *F41A 23/12* (2013.01); *F41A 27/12* (2013.01)

(58) Field of Classification Search
CPC ..... F41A 27/12; F41A 23/12
(Continued)

(56) References Cited

U.S. PATENT DOCUMENTS 1,335,403 A * 3/1920 Stanley ..... F41A 23/12 89/40.06
1,560,564 A 11/1925 Gorton ..... 89/40.06
(Continued)

*Primary Examiner* — Samir Abdosh
(74) *Attorney, Agent, or Firm* — Gerhard W. Thielman, Esq.

(57) ABSTRACT

A tripod is provided for mounting a machine gun between a front pintle and a traverse-and-elevation (T&E) device, being mechanically alterable between stowage and deployment configurations by means of a curved traverse bar. The tripod includes a head member for receiving the front pintle, a fore leg, first and second rear legs, and the traverse bar. The fore leg connects to the head member at a fore pitch hinge, and extends in the deployment configuration and folds aft beneath the head member in the stowage configuration. The first and second rear legs connect to the head member by corresponding rear lateral hinges. Each rear leg has a rail member that slides longitudinally therealong. The rear legs splay outward from the head member in the deployment configuration and contract substantially parallel in the stowage configuration. The traverse bar includes an elongated member for mounting the T&E device, first and second terminals at opposite ends of the elongated member, and a sprocket. The elongated member has an arc curvature that enables the T&E device to travel along the elongated member with constant elevation of the machine gun. The terminals respectively attach to the first and second legs by respective orifices. The first terminal includes a circular serrated cavity to receive the sprocket that has the first pivot orifice being offset from its axial center. The sprocket is removable to rotate the first pivot orifice for subsequent reinsertion into the serrated cavity.

12 Claims, 15 Drawing Sheets

(58) Field of Classification Search
USPC ..... 89/37.01–44.02
See application file for complete search history.

(56) References Cited

U.S. PATENT DOCUMENTS

| | | | | | |
|---|---|---|---|---|---|
| 1,671,281 | A | | 5/1928 | Gorton | 89/40.06 |
| 1,722,629 | A | | 7/1929 | Hatcher | 89/40.06 |
| 1,977,629 | A | * | 10/1934 | Heavey | F41A 23/12<br>89/40.06 |
| 2,003,327 | A | * | 6/1935 | Woodberry | F41A 23/12<br>89/40.06 |
| 2,415,024 | A | | 1/1947 | Allen | 280/103 |
| 2,429,713 | A | | 10/1947 | Frease | 74/47 |
| 4,066,000 | A | | 1/1978 | Rostocil | 42/25 |

* cited by examiner

RECEIVED
MAR 10 2017
LICENSING & REVIEW

TRIPOD MOUNT WITH A TRAVERSE SUPPORT MECHANISM

CROSS REFERENCE TO RELATED APPLICATION

The invention is a Continuation-in-Part, claims priority to and incorporates by reference in its entirety U.S. patent application Ser. No. 14/752,707 filed Jun. 26, 2015, issued as U.S. Pat. No. 9,518,795 on Dec. 13, 2016 and assigned Navy Case 103685.

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to lock and release legs on a machine gun tripod while enabling level sweep. In particular, the invention relates to a traverse bar to secure a tripod's rear legs and support a traverse-and-elevation mechanism for a machine gun.

The United States Army (USA) and United States Marine Corps (USMC) have used the M122 machine gun tripod since about 1935, which provides a more stable and versatile platform for accurate and controlled angular sweep during successive firings than available by the bipod mounted to a standard M240 machine gun.

FIG. 1 shows an isometric view 100 of a conventional M122 tripod and its main components, including the tripod stand 110. A mounting head 120 includes a pintle bushing 125 into which a front yoke (not shown) can be inserted. A front leg 130 with front foot pad attaches to the head 120. The tripod 110 also includes a pair of rear legs extending from the head 120: rear starboard leg 140, and rear port leg 150. The starboard and port legs 140 and 150 connect together by a traverse bar 160 to maintain fixed angular separation.

A traverse-and-elevation (T&E) mechanism (not shown) attaches to the traverse bar 160 to adjust the firing direction of the gun M240. The conventional traverse bar 160 is typically straight and connects to each rear leg by a sleeve 170, which for the starboard leg 140 includes a clamp 175 to secure and release the traverse bar 160. A compass rose 180 indicates orientation, with the rightward longitudinal axis denoting forward direction, upward elevation axis denoting upward vertical direction, and diagonal lateral axis denoting port side direction. The conventional M122 tripod weighs 12.3 lb alone.

SUMMARY

Conventional traverse support mechanisms yield disadvantages addressed by various exemplary embodiments of the present invention. In particular, various exemplary embodiments provide a tripod for mounting a machine gun between a front pintle and a traverse-and-elevation (T&E) device, being mechanically alterable between stowage and deployment configurations by means of a curved traverse bar. The tripod includes a head member for receiving the front pintle, a fore leg, first and second rear legs, and the traverse bar. The fore leg connects to the head member at a fore pitch hinge, and extends in the deployment configuration and folds aft beneath the head member in the stowage configuration.

The first and second rear legs connect to the head member by corresponding rear lateral hinges. Each rear leg has a rail member that slides longitudinally therealong. The rear legs splay outward from the head member in the deployment configuration and contract substantially parallel in the stowage configuration. The traverse bar includes an elongated member for mounting the T&E device, first and second terminals at opposite ends of the elongated member, and a sprocket.

The elongated member has an arc curvature that enables the T&E device to travel along the elongated member with constant elevation of the machine gun. The terminals respectively attach to the first and second legs by respective pivot orifices. The first terminal includes a circular serrated cavity to receive the sprocket with the first pivot orifice offset from its axial center. The sprocket is removable to rotate the first pivot orifice for subsequent reinsertion into the serrated cavity.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Figure 1:
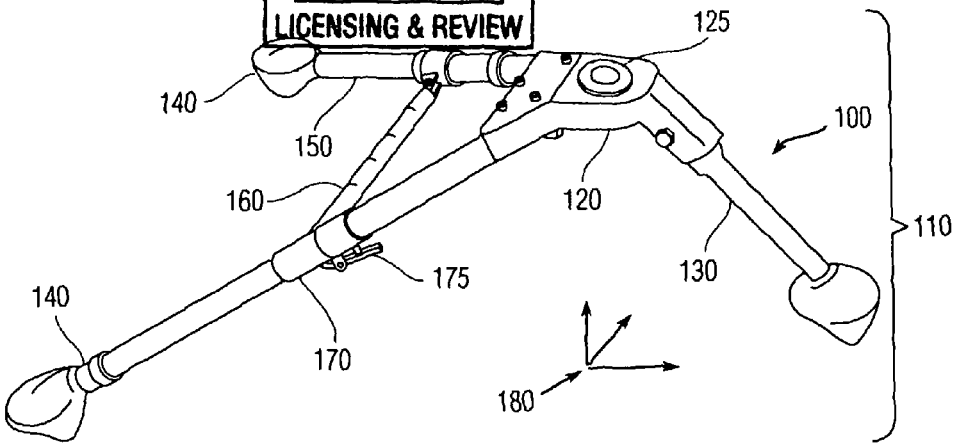
PRIOR ART Fig. 1
FIG. 1 is a perspective view of a conventional machine gun tripod.
Figure 2:
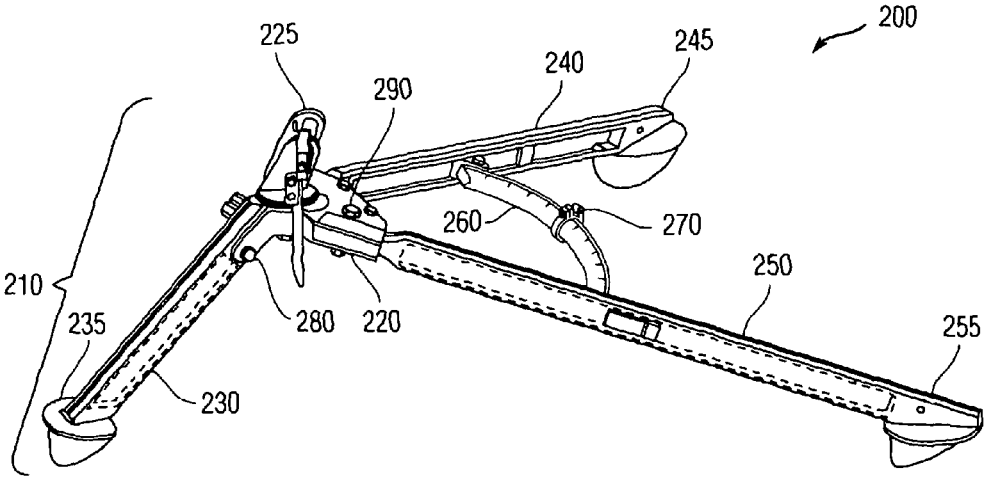
FIG. 2 is a perspective assembly view of an exemplary machine gun tripod.

Dahlgren has been tasked to design a replacement yet functional tripod with reduced weight. FIG. 2 shows a perspective assembly view 200 of an exemplary XM131C Rev C tripod 210 for a machine gun (depicted in U.S. Pat. No. 9,518,795 with incorporation by reference). A mounting head 220 with a front pintle 225 provides the locus for a fore leg 230 with front foot 235, and angularly splayed rear legs: starboard leg 240 with right foot 245 and port leg 250 with left foot 255. The machine gun pivots on the tripod 210 at a front yoke mount on the front pintle 225. An exemplary traverse bar 260 connects the rear legs 240 and 250. An angular traverse stop clamp 270 (described in U.S. Pat. No. 9,518,795 with incorporation by reference) attaches to the traverse bar 260 to restrict travel of the T&E mechanism (depicted in U.S. Pat. No. 9,518,795) that mounts thereto. The traverse bar 260 includes an elongated section that spans between the rear legs 240 and 250 in an arc that curves to enable the T&E mechanism to sweep the machine gun from side to side while maintaining constant elevation while on a flat surface.

The fore leg 230 pivotably attaches to the head 220 at a pitch hinge 280. The rear legs 240 and 250 pivotably attach to the head 220 at respective lateral hinges 290. The feet pads 235, 245 and 255 are designed to penetrate into ground to provide a stable platform from which to fire the machine gun. The weight of the M131C Mod C tripod 210 is 7.4 lb absent pintle 225 and T&E mechanism. Total weight of the exemplary tripod 210 with the pintle 225 and the T&E mechanism is 12.1 lb total. This constitutes an improved reduced weight over the conventional M122 tripod 110 of 12.3 lb without the pintle and T&E mechanism and 18.1 lb total.

The exemplary tripod 210 is formed substantially from forged aluminum components and the legs 230, 240 and 250 form wide flange cross-section structures rather than tubes to reduce weight. Aluminum alloys can include 6061-T6 and 7075-T6, for example. The fore leg 230 has an approximate length of nine inches and is elevated from ground level by 45°, and the rear legs 240 and 250 have approximate lengths of seventeen inches and are elevated from the ground by 20°. The rear legs 240 and 250 are angularly separated by 115°. These dimensions are exemplary for the configuration designed, and are not limiting.

Figure 3A:
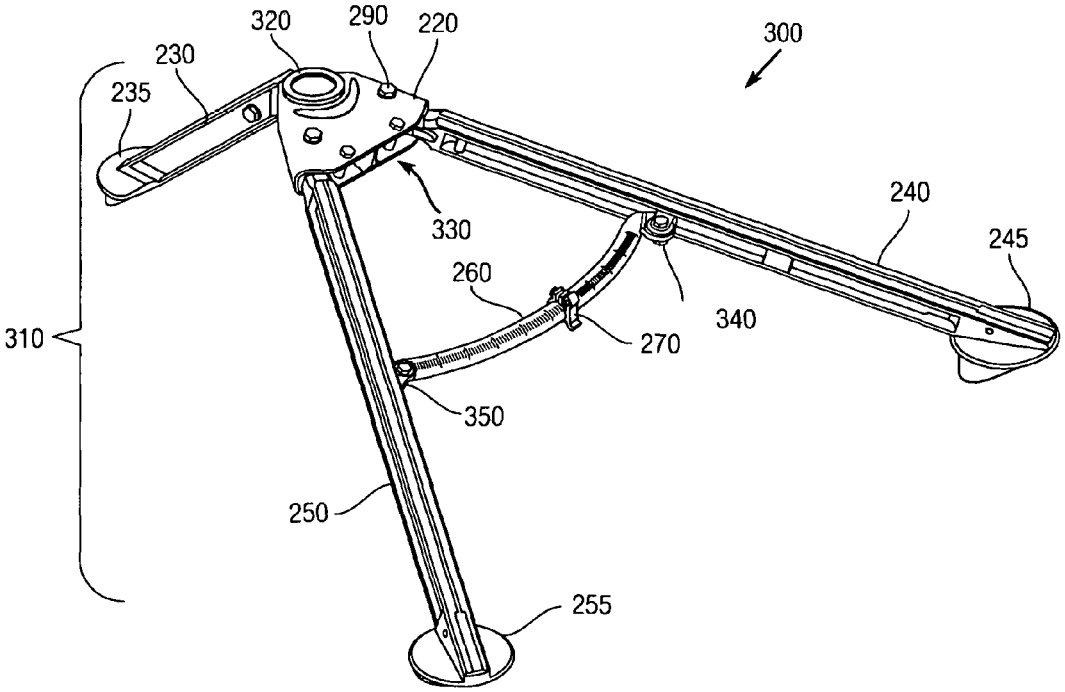
FIGS. 3A through 3D are perspective views of the exemplary tripod.
Figure 3B:
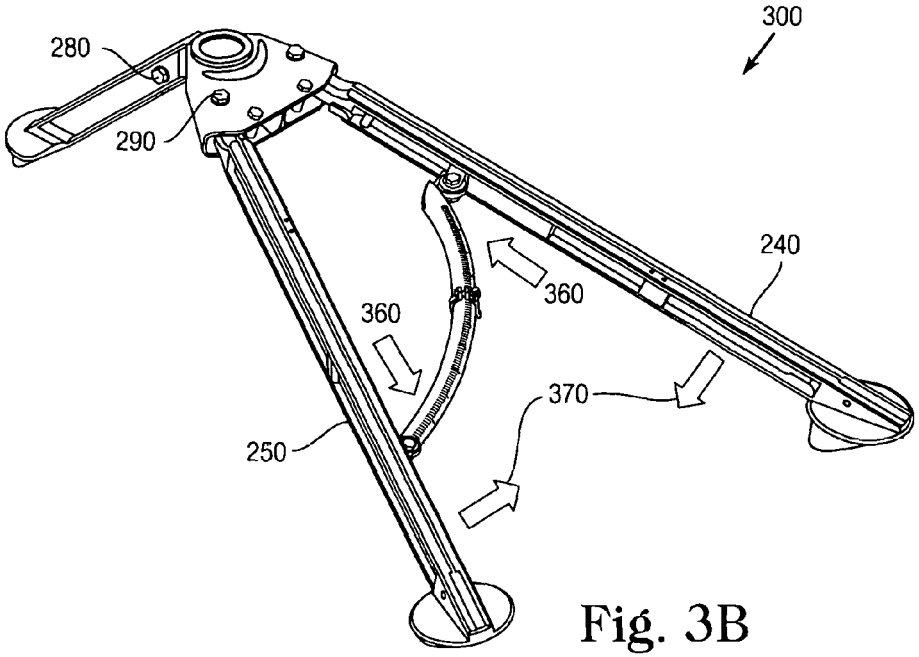
Figure 3C:
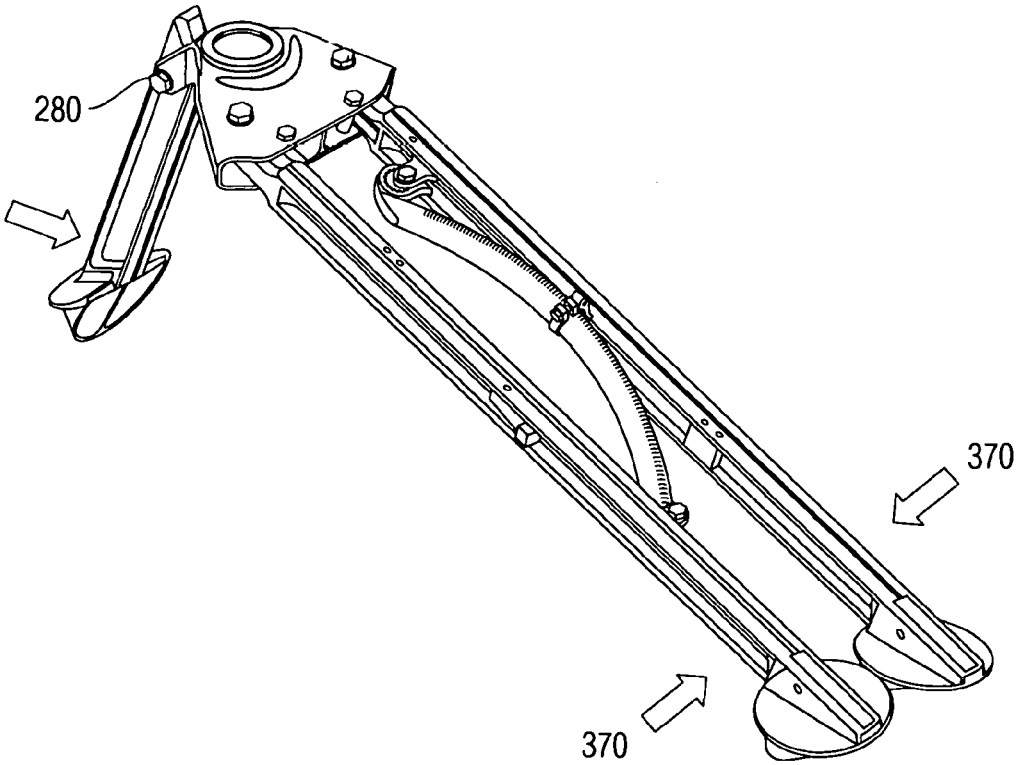
Figure 3D:
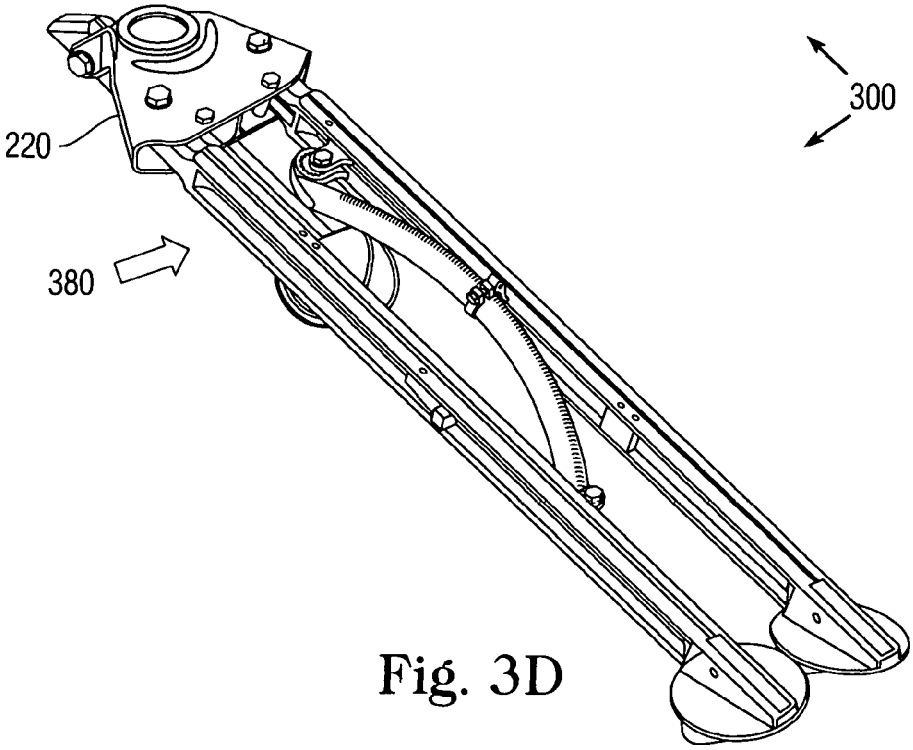

FIGS. 3A through 3D show perspective views 300 of the exemplary M131 tripod 310 (including the clamp 270). In FIG. 3A, an exemplary tripod assembly 310 is shown as deployed. A pintle bushing 320 on the head 220 receives the front pintle 270 (shown in FIGS. 2 and 14A through 14C). The head 220 includes an aft chamber 330 that enables the rear legs 240 and 250 to rotate within at their respective hinges 290. The exemplary traverse bar 260 attaches to the starboard leg 240 at a right joint 340 and to the port leg 250 at a left joint 350. In FIG. 3B, the tripod assembly 310 is being partially collapsed for stowage and/or transport. Forward and rearward forces cause the right joint 340 and the left joint 350 to slide respectively forward and aft in alternating directions 360. The right joint 340 also pivots to rotate counter-clockwise (as viewed from above). This action causes the rear legs 240 and 250 to pivot towards each other in converging directions 370 held by their respective hinges 290. In FIG. 3C, the rear legs 240 and 250 are furled to be mutually parallel, and the fore leg 230 rotates at its hinge 280 so the front foot 235 moves aft 380. In FIG. 3D, the fore leg 230 is folded underneath the head 220.

Figure 3E:
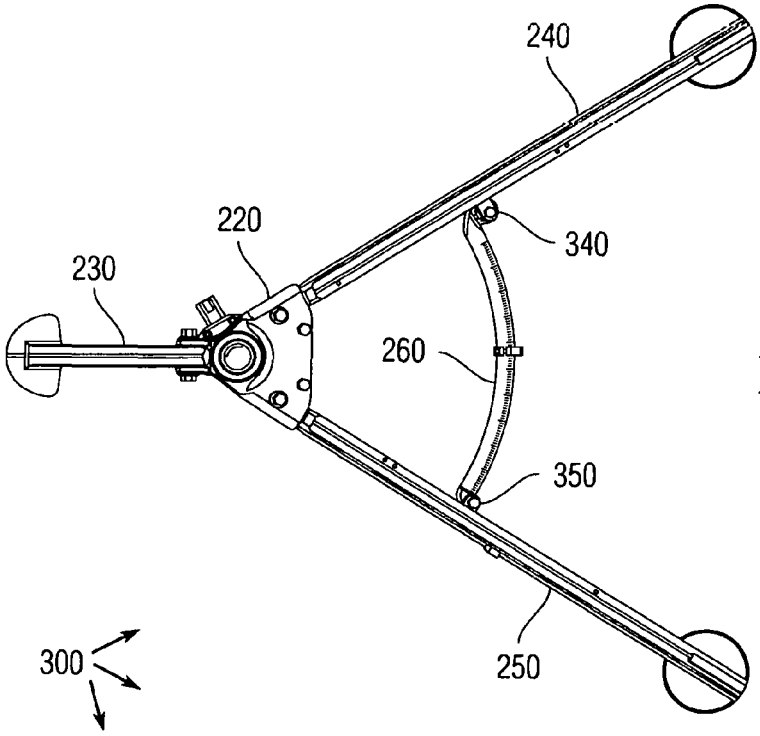
FIGS. 3E through 3G are plan views of the exemplary tripod.
Figure 3F:
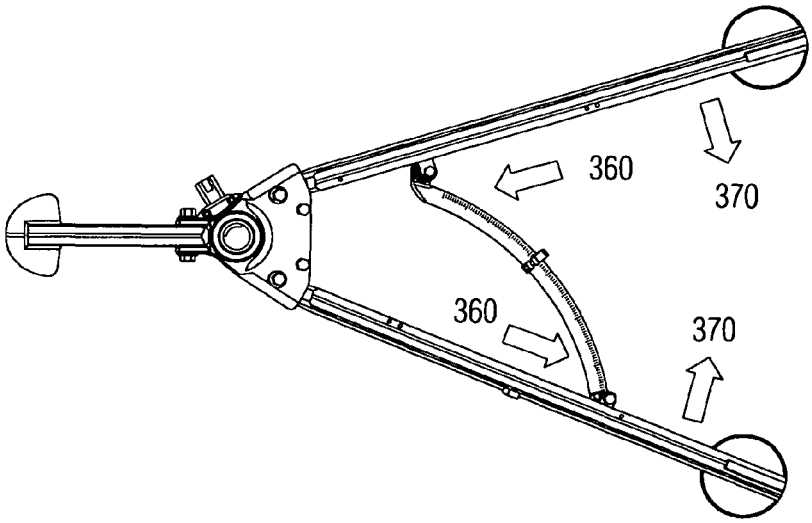
Figure 3G:
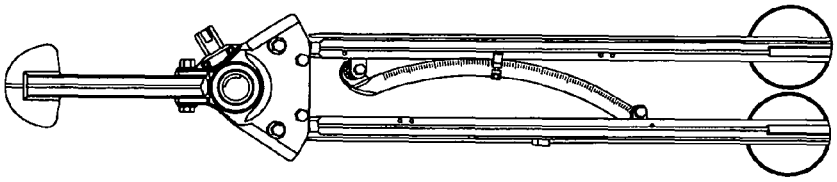

FIGS. 3E through 3G show plan views 390 of the exemplary M131 tripod. In FIG. 3E, the tripod 310 is shown as deployed. In FIG. 3F, the tripod 310 is shown with the traverse bar 260 sliding and rear legs 240 and 250 pivoting towards each other. In FIG. 3G, the tripod 310 is shown with the rear legs 240 and 250 stowed as mutually parallel.

Figure 4:
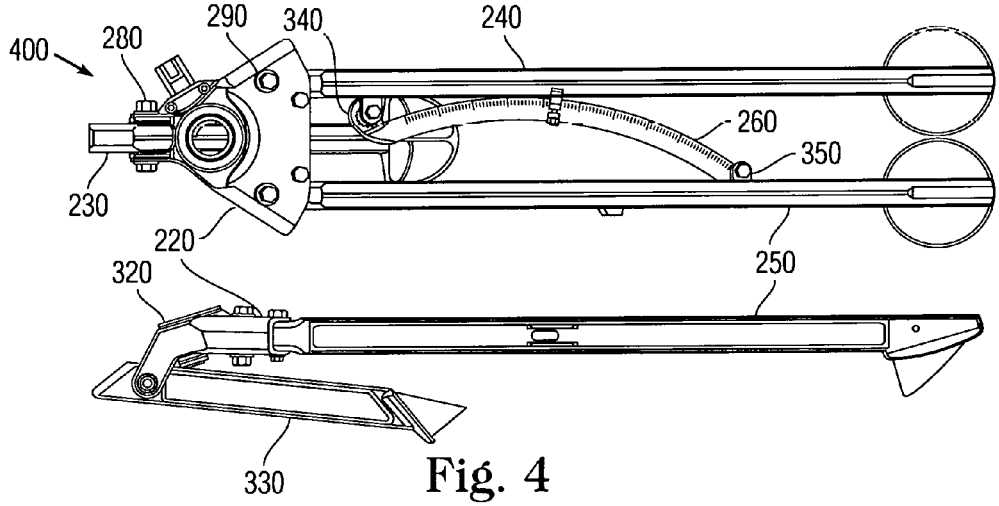
FIG. 4 is plan and elevation views of the exemplary tripod, folded.
Figure 5:
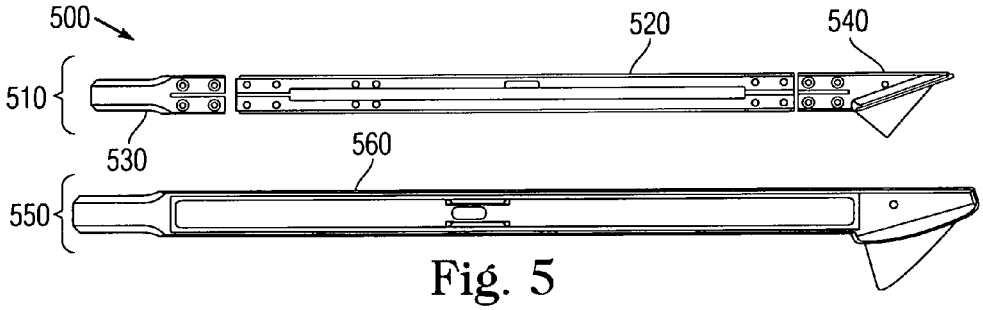
FIG. 5 is an elevation view of exemplary legs for the tripod.

FIG. 4 shows plan and elevation views 400 of the exemplary tripod as folded. The fore leg 230 is disposed under the head 220, and the rear legs 240 and 250 are collapsed as parallel to each other. FIG. 5 shows an elevation view 500 of exemplary rear leg assemblies 510 and 520 for the tripod. The first M131C tripod embodiment includes a first leg 510 composed of three segments: a proximal segment 530 that attaches to the head 220 at the hinge 290, an extending member 540 that establishes overall design length, and a proximal segment 550 that includes the foot. The second M131C Rev C tripod 310 embodiment includes a second leg 560 constituting a unitary entity, which can be produced by milling a ⅞"×1¼ aluminum billet, or by forging and finishing.

Figure 6:
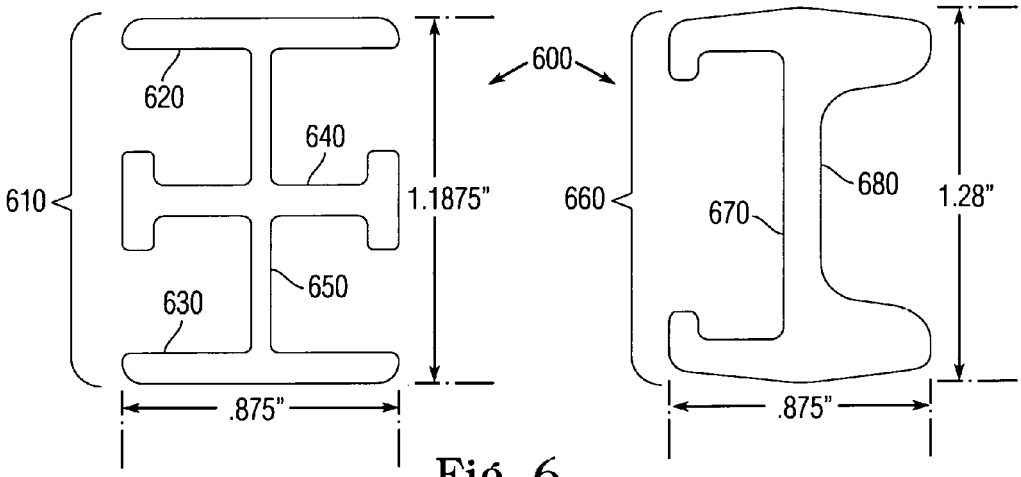
FIG. 6 is a cross-section view of the exemplary legs.

FIG. 6 shows cross-section views 600 of the exemplary legs 510 and 520. A first cross-section 610 with cruciform shape includes top flange 620, bottom flange 630 and mezzanine flange 640 joined together by a vertical spar 650 for the M131C configuration. Cross-sectional dimensions for the first leg 510 include height of 1.1875 inches and width of 0.875 inch. A second cross-section 660 includes an inner face 670 and an outer face 680 in relation to the opposite leg for the M131C Rev C configuration. Cross-sectional dimensions for the second leg 520 include height of 1.28 inches and width of 0.875 inch.

Figure 7:
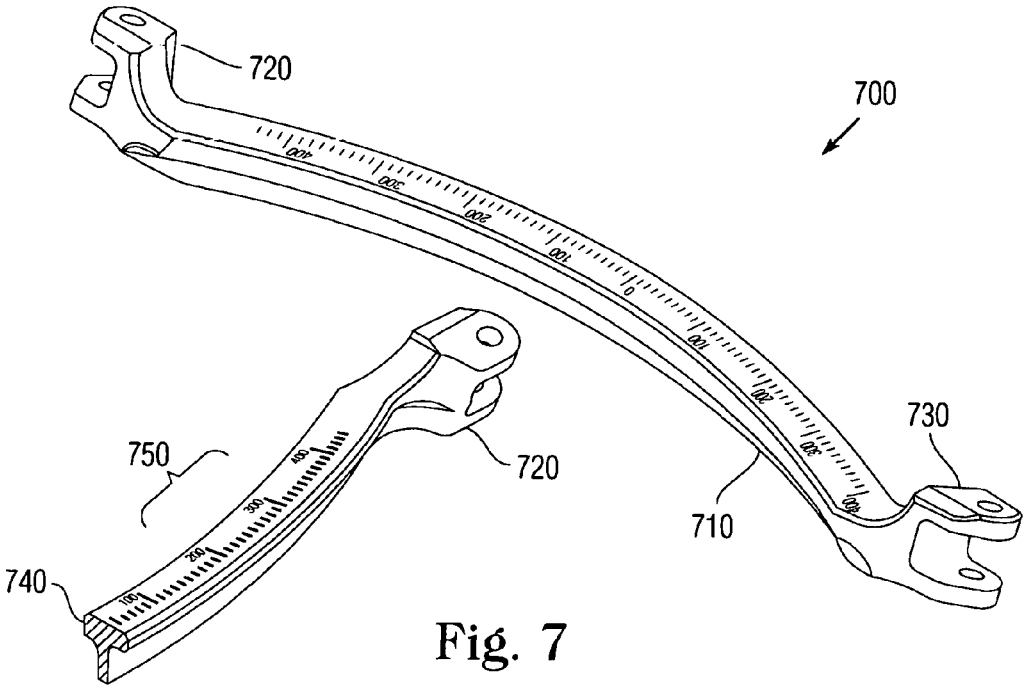
FIG. 7 is a perspective view of a first exemplary traverse bar.

FIG. 7 shows perspective views 700 of a first exemplary traverse bar 720. A right end 720 and a left end 730 are joined by a curved span therebetween having a T-shape cross-section 740, the curved span including scale marks 750 for setting the position for the T&E mechanism. The ends 720 and 730 each have two clevis prongs to form a pin joint at connections to their respective legs 240 and 250.

Figure 8:
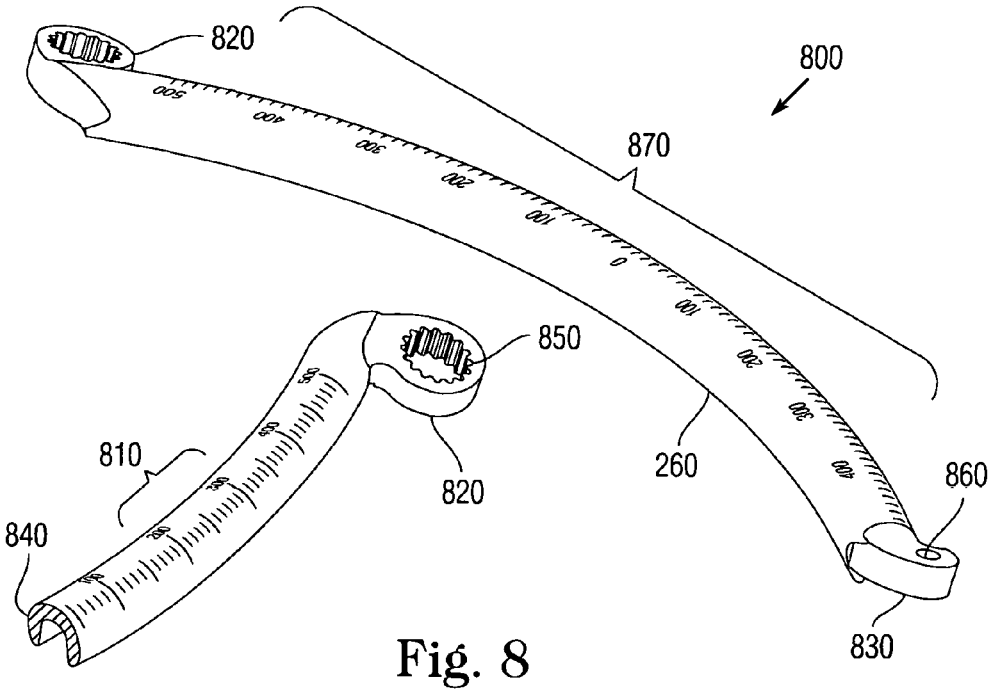
FIG. 8 is a perspective view of a second exemplary traverse bar.

FIG. 8 shows perspective views 800 of a second exemplary traverse bar 260 shown with the exemplary tripod assembly 210. The curved span of the traverse bar 260 includes scale marks 810 to denote angles for the T&E mechanism. Right and left ends 820 and 830 are joined by the curved span therebetween having a C-shape cross-section 840. The right end or terminus 820 includes a serrated (or toothed) circular cavity 850. The left end or terminus 830 constitutes a tang with a left through-hole 860 to provide a pin joint for connecting to a clevis on its respective leg 250. The curved segment between the ends can be called an elongated member 870.

Figures 9A, 9B:
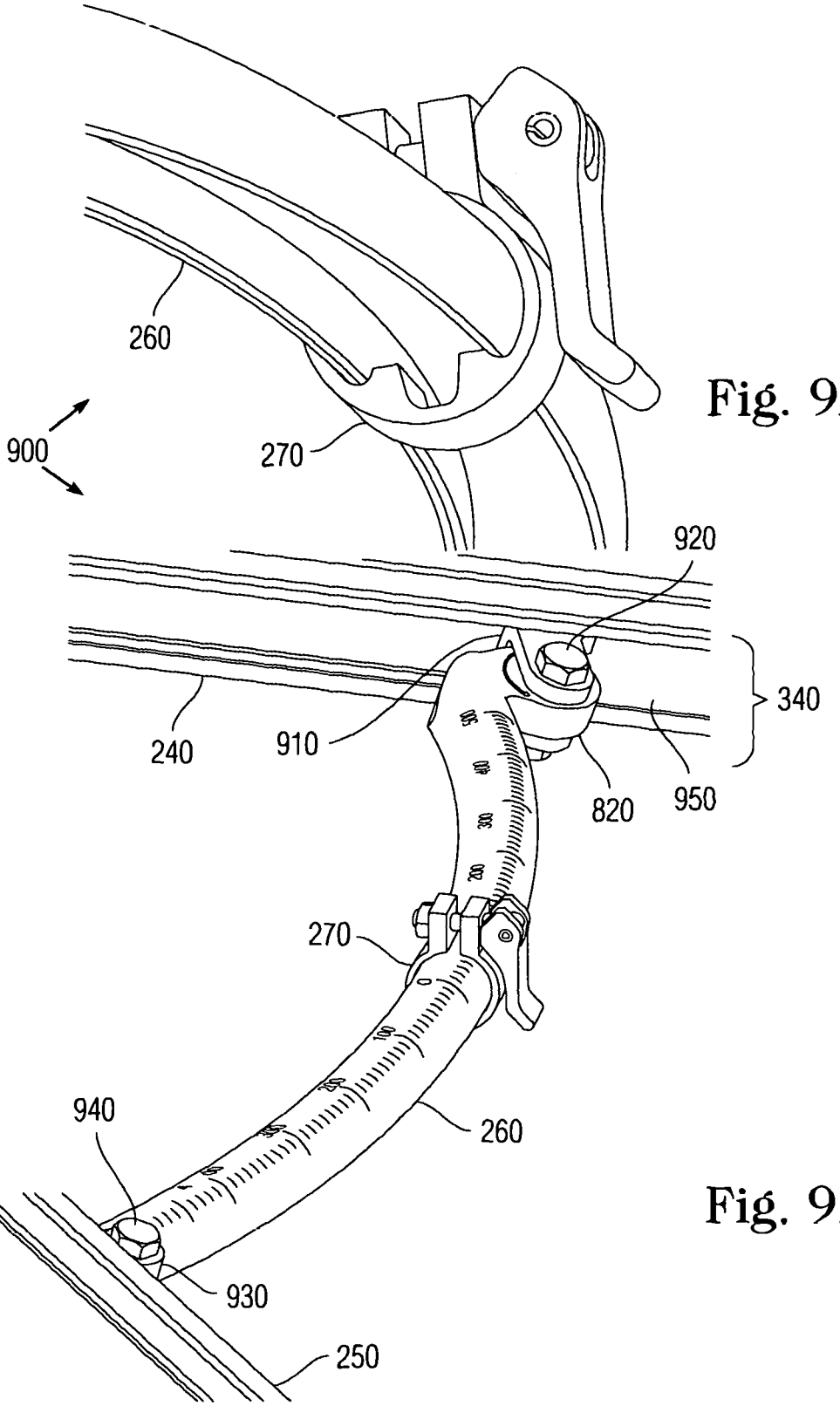
FIGS. 9A and 9B are perspective views of the second exemplary traverse bar with an exemplary clamp.

FIGS. 9A and 9B show perspective views 900 of the second exemplary traverse bar 260 with an exemplary stop clamp 270 described in U.S. Pat. No. 9,518,795. FIG. 9A illustrates the open-ring configuration of the stop clamp 270 engaging the traverse bar 260 with its C-shape cross-section from below. FIG. 9B shows the traverse bar 260 connected to the rear legs 240 and 250. The right end 820 for corresponding joint 340 attaches to a first clevis bracket 910 on the starboard leg 240 and secured by a bolt 920. The left end 830 for corresponding joint 350 attaches to a second clevis bracket 930 on the port leg 250 and secured by a threaded bolt 940 and accompanying nut. The first clevis bracket 910 is disposed on a starboard slide rail 950 that traverses forward along the length of the starboard leg 240.

Figure 10B:
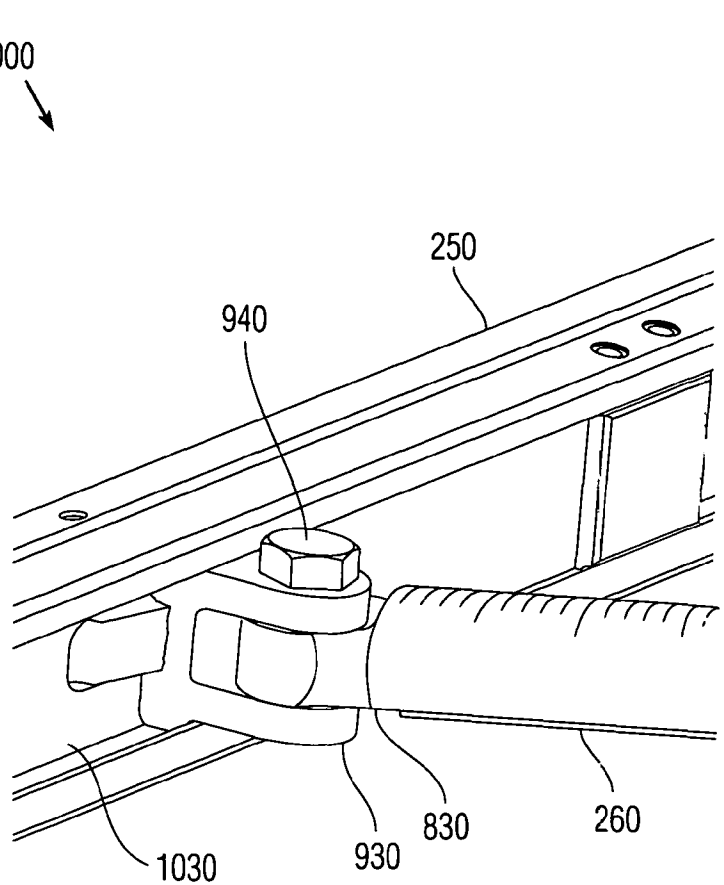
FIGS. 10A and 10B are perspective views of port leg joints for the first and second exemplary traverse bars.
Figure 10A:
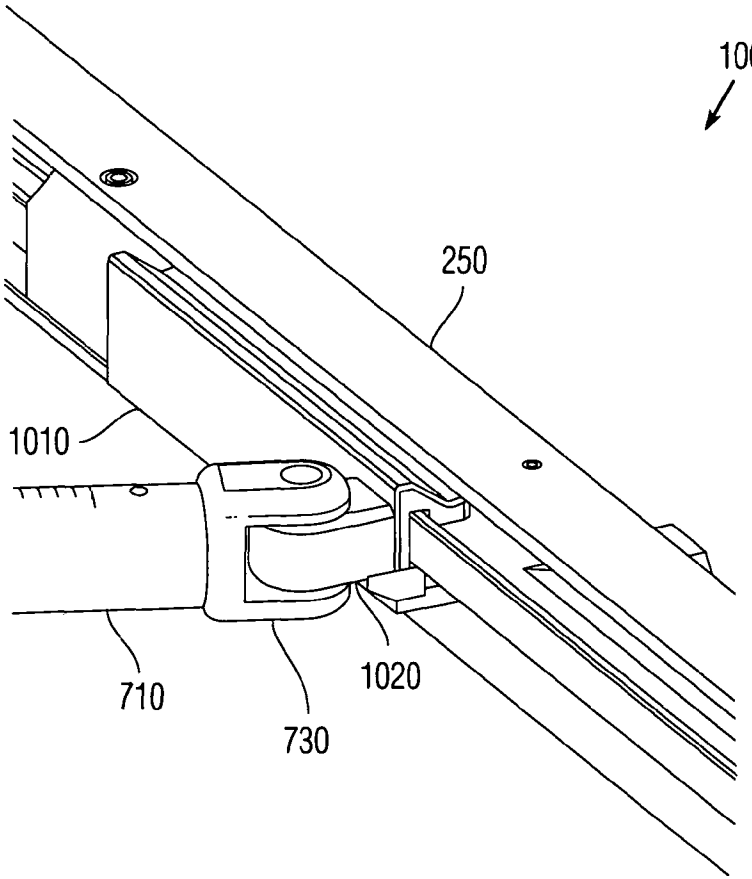

FIGS. 10A and 10B show perspective views 1000 of left leg joints 350 for the first and second exemplary traverse bars. FIG. 10A illustrates the first traverse bar 710 with its clevis right end 730 attaching to slide rail 1010 by a tang 1020 disposed on the port leg 250. FIG. 10B shows the second traverse bar 260 with its tang right end 830 attaching to a port side rail 1030 by the second clevis bracket 930 disposed on the port leg 250 and secured by bolt 940. The port side rail 1030 traverses aft along the length of the port leg 250.

Figure 11:
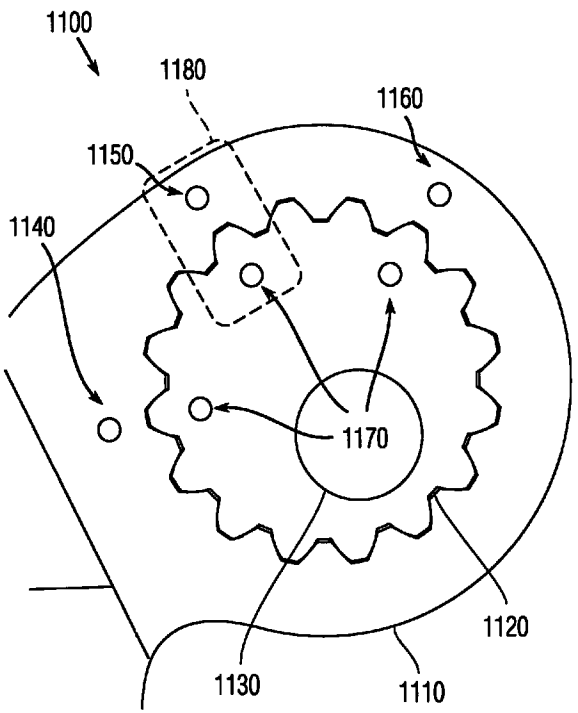
FIG. 11 is a plan view of a primary starboard leg joint for the traverse bar.

FIG. 11 shows a plan view 1100 of a first exemplary embodiment of a right end assembly 1110 for the right joint 340. The assembly 1110 includes the right end 820 of the traverse bar 260 together with a sprocket 1120 that inserts into the corresponding cavity 850 that extends through the right end 820. The sprocket 1120 includes an off-center circular orifice 1130 to pivot the right joint 340. This means that the center of the circular orifice 1130 is offset from the axial center of the sprocket 1120. The right end 820 includes exterior marks 1140, 1150 and 1160 for aligning to interior marks 1170 on the sprocket 1120. Alignment of corresponding marks 1150 and 1170 is exemplified by an enveloped example 1180. Relative disposition of the offset orifice 1130 in relation to the right end 820 can provide longer or shorter effective span of the traverse bar 260, with which to adjust tension between the rear legs 240 and 250 that possible deformation under field operations may necessitate. Changing the angular position of the sprocket 1120 within its cavity 850 alters the position of the offset orifice 1130, and thus the effective distance from the right joint 340 to the mounting hole 860 at the left end 830 at the left joint 350, thereby enabling span of the traverse bar 260 to be shortened or lengthened.

Figure 12:
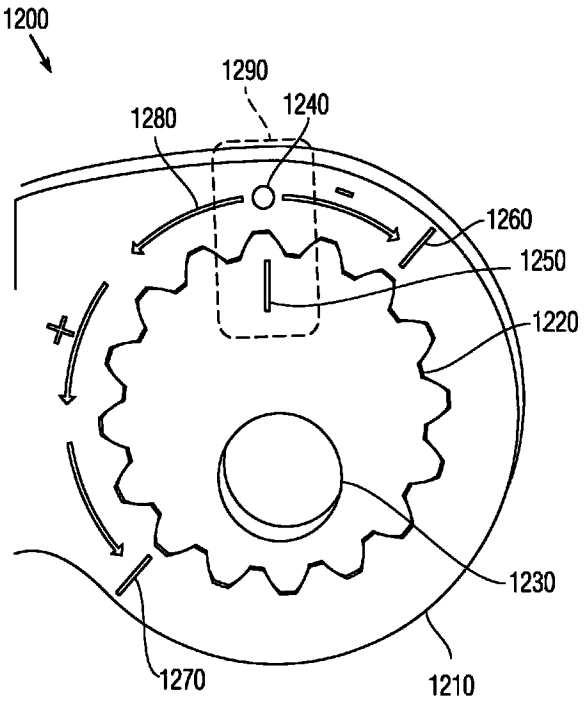
FIG. 12 is a perspective view of a secondary starboard leg joint for the traverse bar.

FIG. 12 shows a perspective view 1200 of a second exemplary embodiment of a right end assembly 1210 for the right joint 340. The assembly 1210 includes the right end 820 of the traverse bar 260 together with a sprocket 1220 that inserts into the corresponding cavity 850 that extends through the right end 820. The sprocket 1220 includes an off-center circular orifice 1230 to pin the right joint 340. This means that the center of the circular orifice 1230 is offset from the axial center of the sprocket 1220. The right end 820 includes an exterior mark 1240 that aligns with an interior mark 1250 disposed on the sprocket 1120. Additional bracketing marks 1260 and 1270 angularly extend in arks 1280 from the exterior mark 1240 from either side along the rim of the right end 820. An envelope 1290 denotes the alignment of the exterior and interior marks 1240 and 1250 for disposition of the offset orifice 1230. The alternative configurations of the sprocket 1220 within the cavity 850 are substantially identical to those described with sprocket 1120 to adjust the length of the traverse bar 260.

Alternative alignment of the interior mark 1250 to the negative mark 1260 shifts the relative position of the orifice 1230 for the minimum length of the traverse bar 260. Alternative alignment of the interior mark 1250 to the positive mark 1270 shifts the relative position of the orifice 1230 for the maximum length of the traverse bar 260, to compensate for tensile-induced deformation at the hinges 290 on the head 220. The mark 1250 on the sprocket 1120 and marks 1240, 1260 and 1270 on the right end 820 facilitate assembly for default standard positions, as well as providing a reference when adjusting the length of the traverse bar 260. Exemplary embodiments preferably utilize standard gear sizes for the sprocket 1120 and standard broach sizes for the cavity 850 to facilitate economical manufacture of these components. The scale legend 1280 inscribed into the surface of the right end 820 indicates the rotation direction the insert to either increase or decrease tension between the rear legs 240 and 250.

Figures 13A, 13B, 13C:
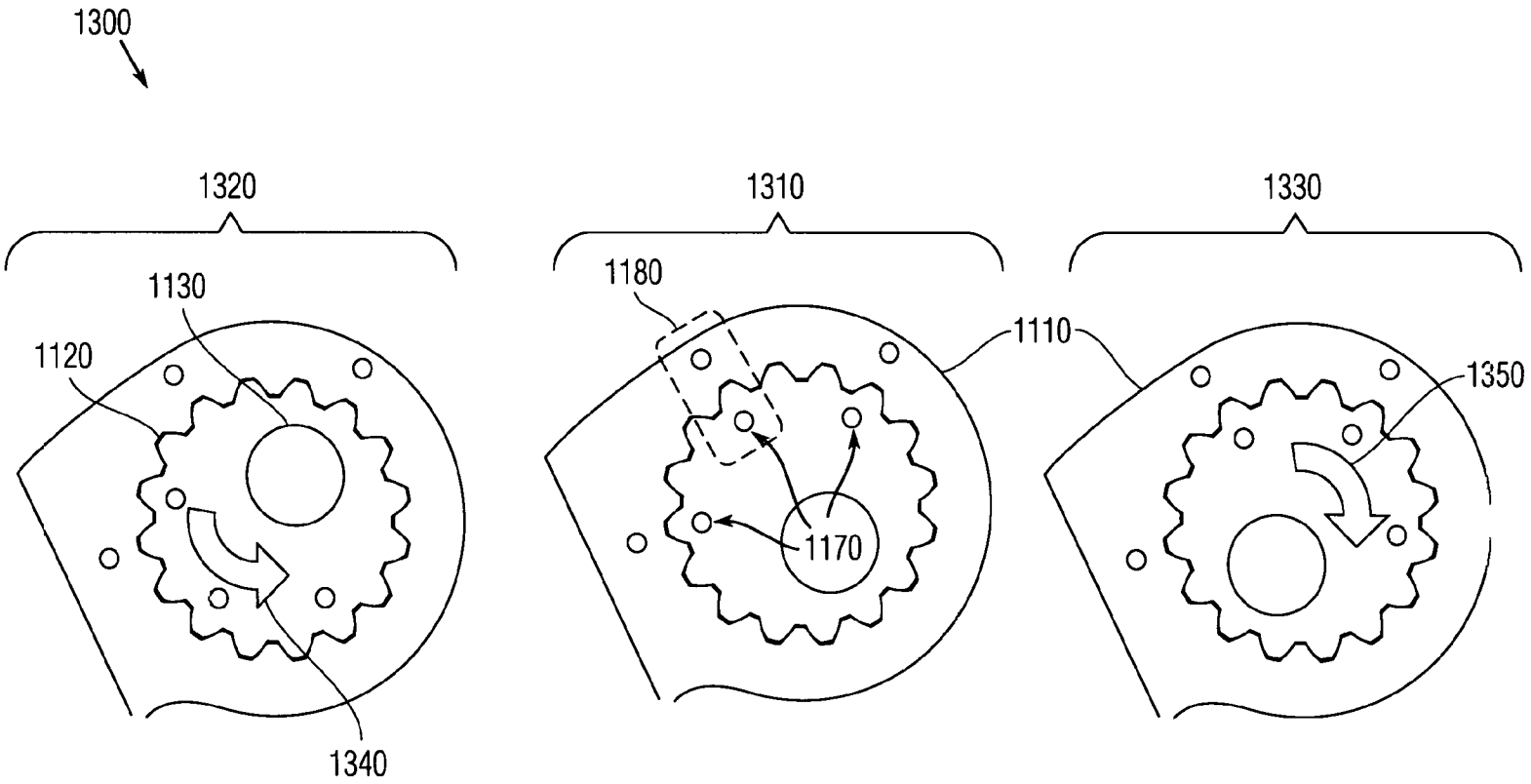
FIG. 13A through 13C are plan views of the primary starboard leg joint at select tension positions.

FIGS. 13A through 13C show plan views 1300 first right end assembly 1110 at select sprocket positions 1310, 1320 and 1330 for varying lengths of the traverse bar 260 to adjust tension between the rear legs 240 and 250. FIG. 13B illustrates the first position 1310 that corresponds to view 1100. FIG. 13A shows the second tensile position 1320 with the sprocket 1120 turned counter-clockwise 1340 in the cavity 850 from the first position 1310 so that the orifice 1130 corresponds to the maximum length of the traverse bar 260. FIG. 13C shows the third tensile position 1330 with the sprocket 1120 turned clockwise 1350 in the cavity 850 from the first position 1310 so that the orifice 1130 corresponds to the minimum length of the traverse bar 260.

Figure 14A:
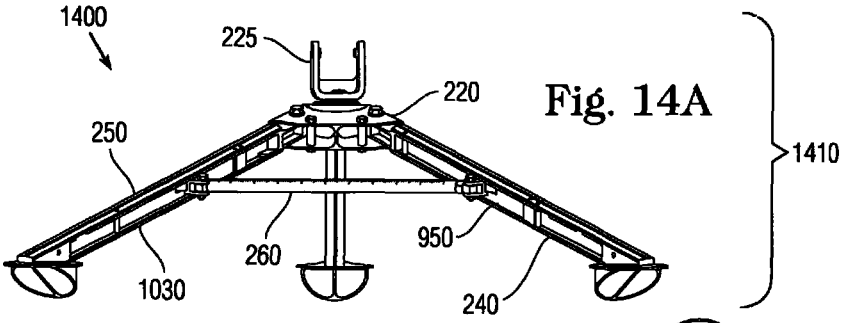
FIG. 14A is an elevation axial view of the exemplary tripod.
Figure 14B:
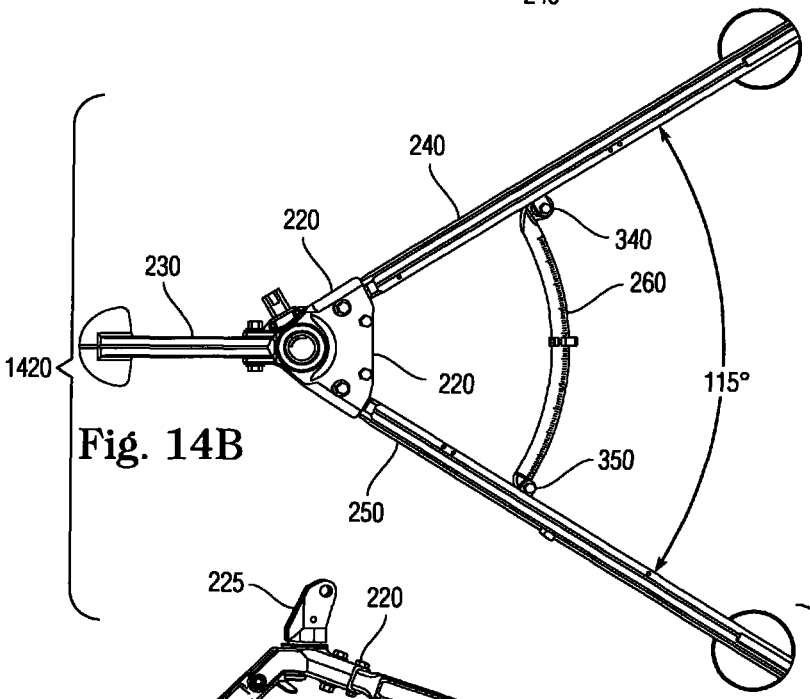
FIG. 14B is a plan view of the exemplary tripod.
Figure 14C:
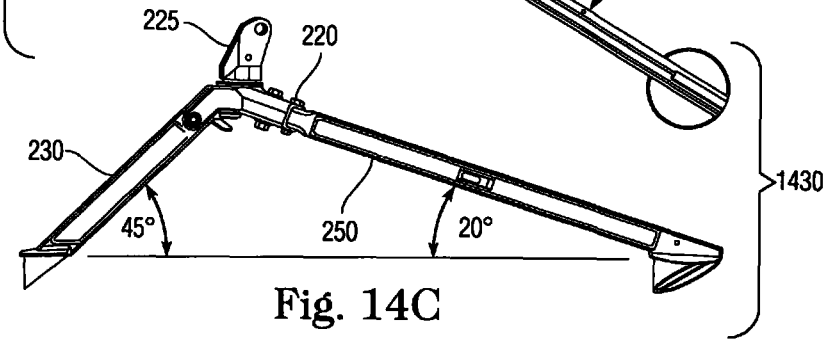
FIG. 14C is an elevation lateral view of the exemplary tripod.

FIGS. 14A through 14C show views 1400 of the exemplary tripod 210 (excluding the clamp 270) as deployed. FIG. 14A exhibits the elevation axial view 1410 of the tripod 1410, including slide rails 950 and 1030. FIG. 14B shows the plan view 1420 of the tripod 210 with the rear legs 240 and 250 with angular separation of 115°. FIG. 14C shows the elevation lateral view 1430 of the tripod 210, with azimuth elevations of the fore leg 230 at 45° and of the rear legs 240 and 250 at 20° from ground level. Artisans will recognize that the configuration in which the starboard side incorporates the slide rail 950 constitutes a design decision, but is not limiting, such that reversal of the sides can be contemplated without departing from the scope of the invention.

Figure 15:
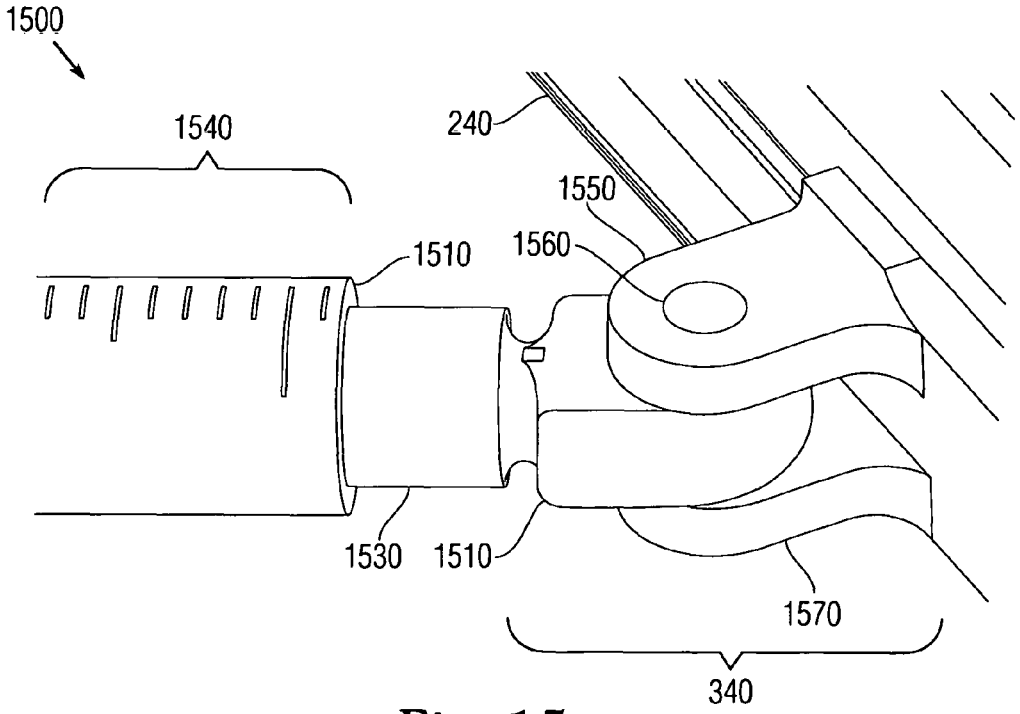
FIG. 15 is a perspective assembly view of the right joint for the third exemplary traverse bar.

FIG. 15 shows a perspective assembly view 1500 of the right joint 340 for a third exemplary traverse bar 1510. A right end 1520 on an extension 1530 from a primary segment 1540 of the traverse bar 1510 inserts into the first clevis bracket 910 at the left joint 350 forms a pivot assembly 1530. The bracket 910 comprises an upper flange 1550 with corresponding through-hole 1560 and a lower flange 1570 with a complementary through-hole (not shown) to pin the right joint 340.

Figure 16:
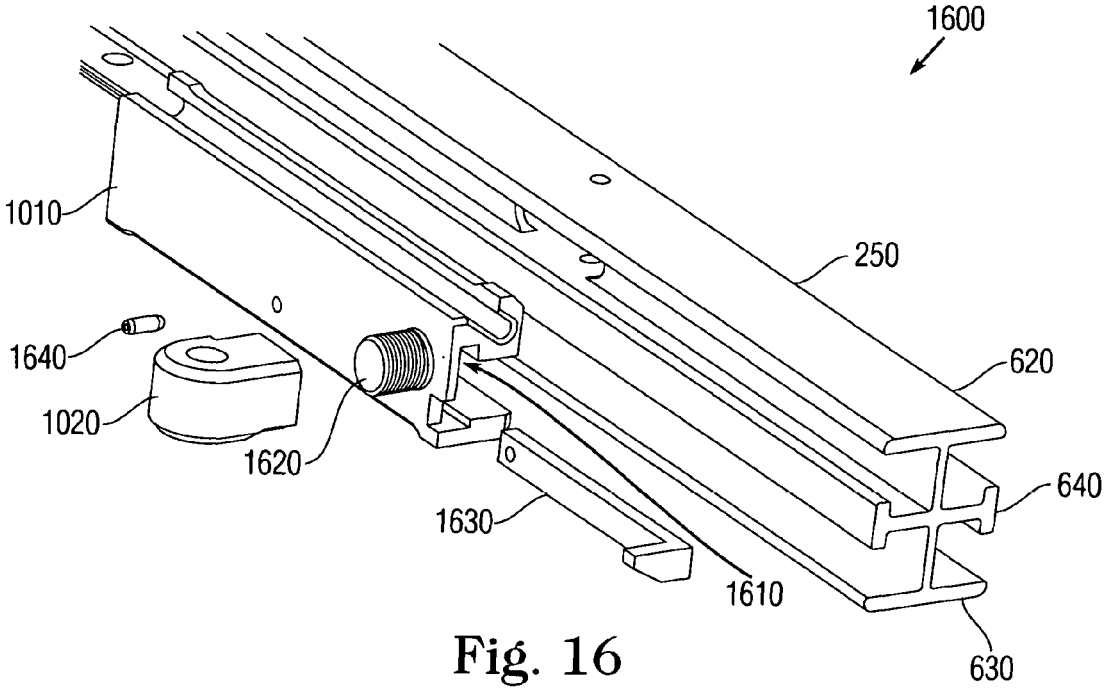
FIG. 16 is a perspective exploded view of the left joint for the first exemplary traverse bar.

FIG. 16 shows a perspective exploded view 1600 of the left joint 350 for the first exemplary traverse bar 710. The port slide rail 1010 attaches to the mezzanine flange 640 of the port leg 250 along a notch channel 1610. The tang 1020 attaches to a threaded stud 1620 on the port slide rail 1010. A flange 1630 secured by a pin 1640 limits travel of the rail 1010.

Figure 17A:
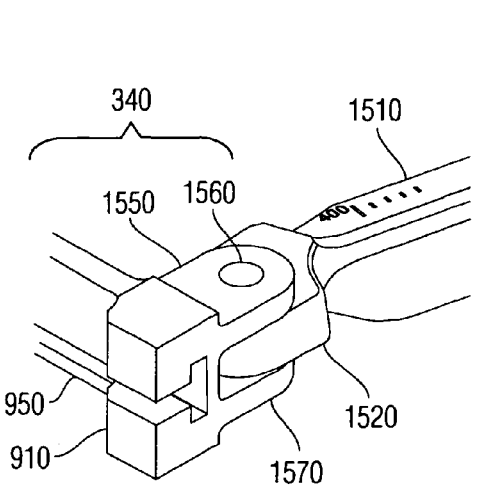
FIGS. 17A and 17B are perspective assembly and exploded views of the right joint for the third exemplary traverse bar.
Figure 17B:
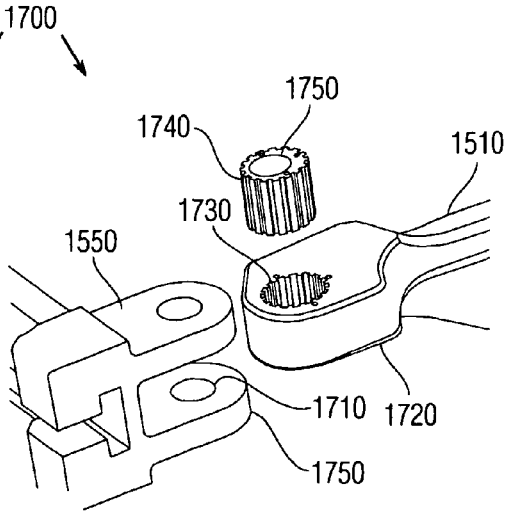
Figure 18:
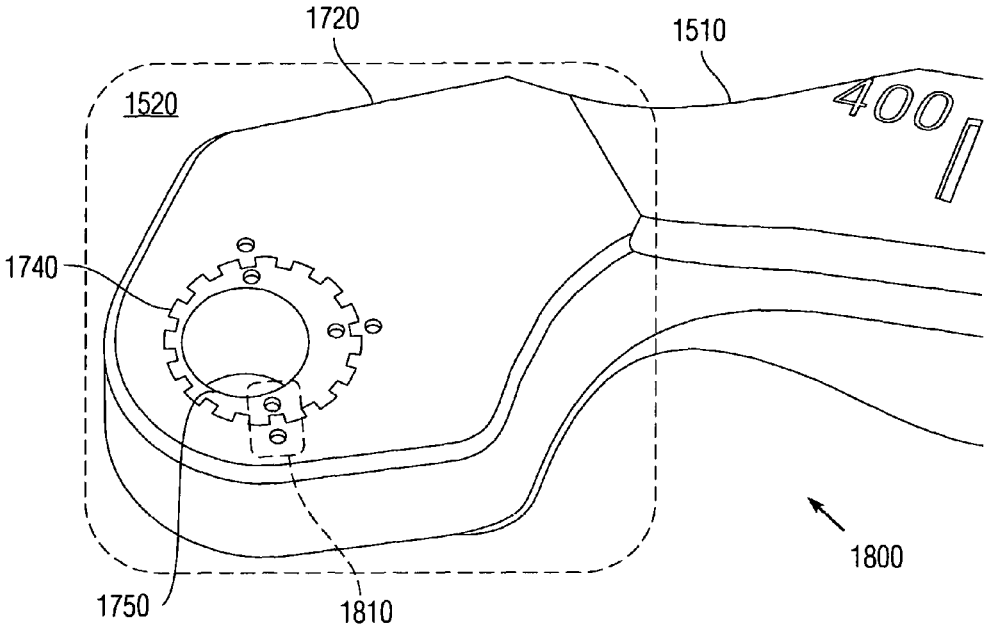
FIG. 18 is a perspective view of the right end for the third exemplary traverse bar.

FIGS. 17A and 17B show perspective assembly and exploded views 1700 of the right joint 340 for the third exemplary traverse bar 1510. The clevis bracket 910 with flanges 1550 and 1570 attaches to the starboard rail 950 and pivotably secures the right end 1520 of the traverse bar 1510 thereto. The right end 1520 includes a terminus 1720 with a serrated cavity 1730 into which inserts a sprocket 1740 having an off-center orifice 1750. FIG. 18 shows a perspective view 1800 of the right end 1520 for the third exemplary traverse bar 1510. Complementary holes 1810 on the terminus 1720 and the sprocket 1740 can be aligned to enable length adjustment of the traverse bar 1510.

Figure 19A:
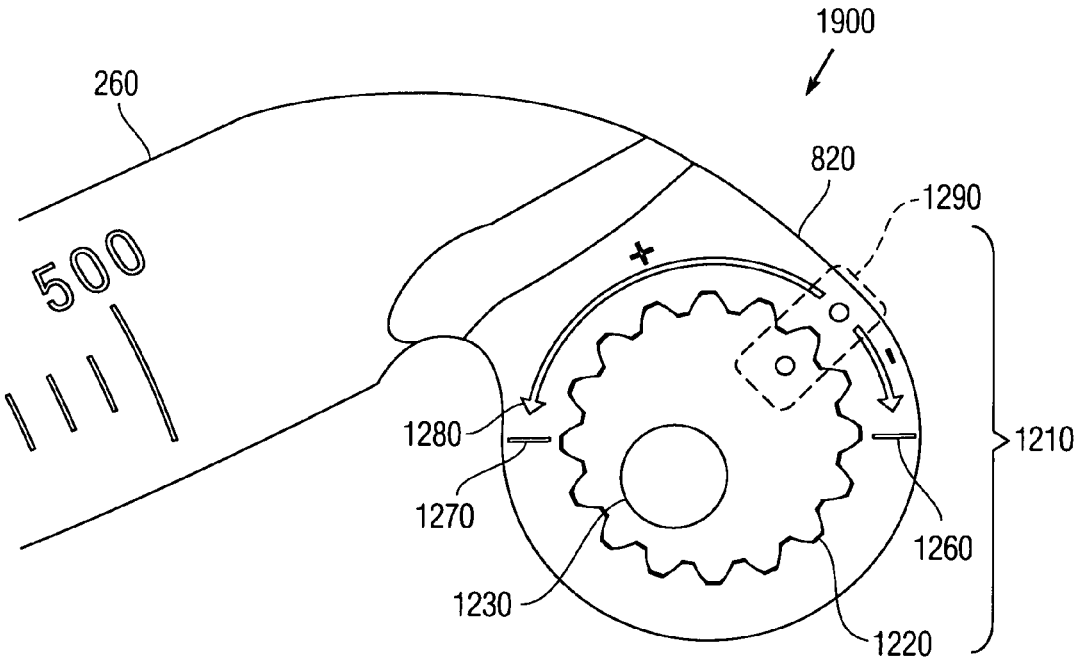
FIGS. 19A and 19B are plan and perspective assembly views of the right end for the first exemplary traverse bar with sprocket insert.
Figure 19B:
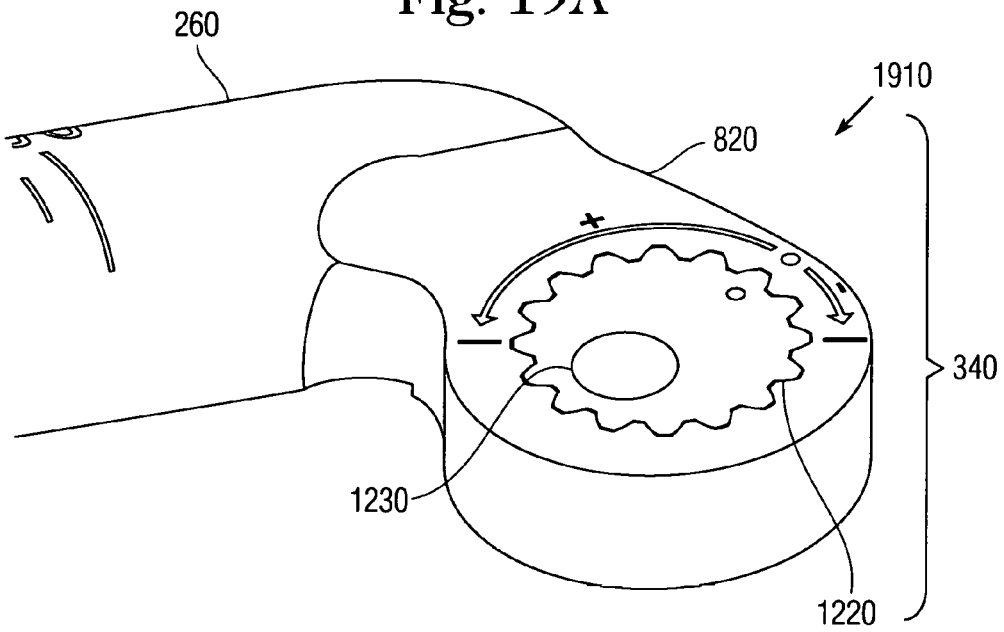
Figure 20A:
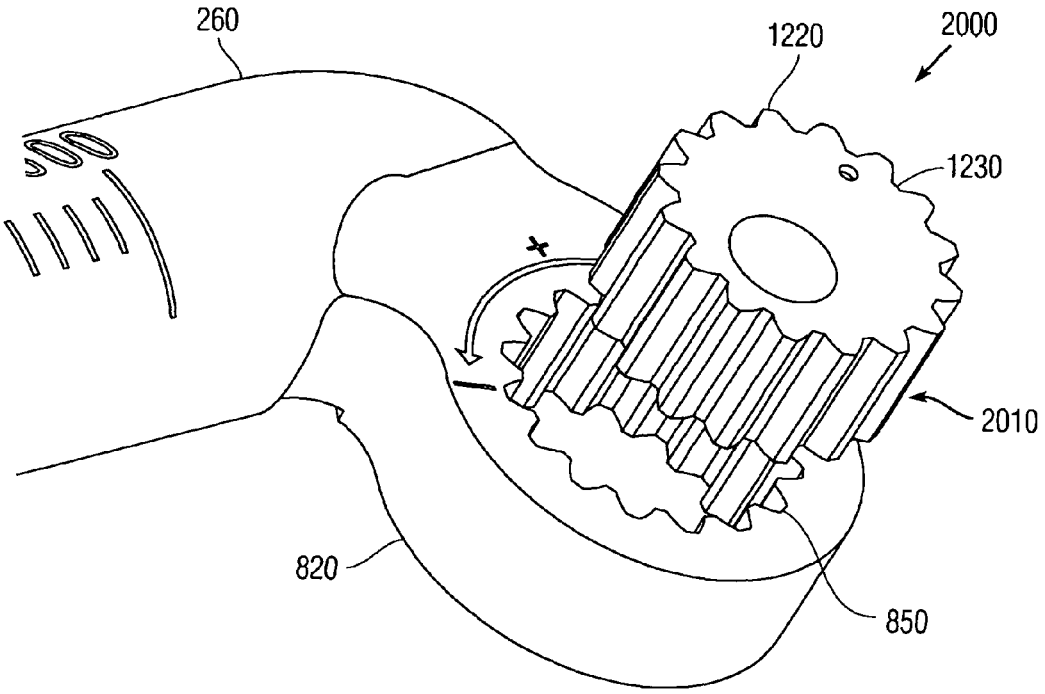
FIGS. 20A and 20B are perspective exploded views of the right end for the first exemplary traverse bar with sprocket insert.
Figure 20B:
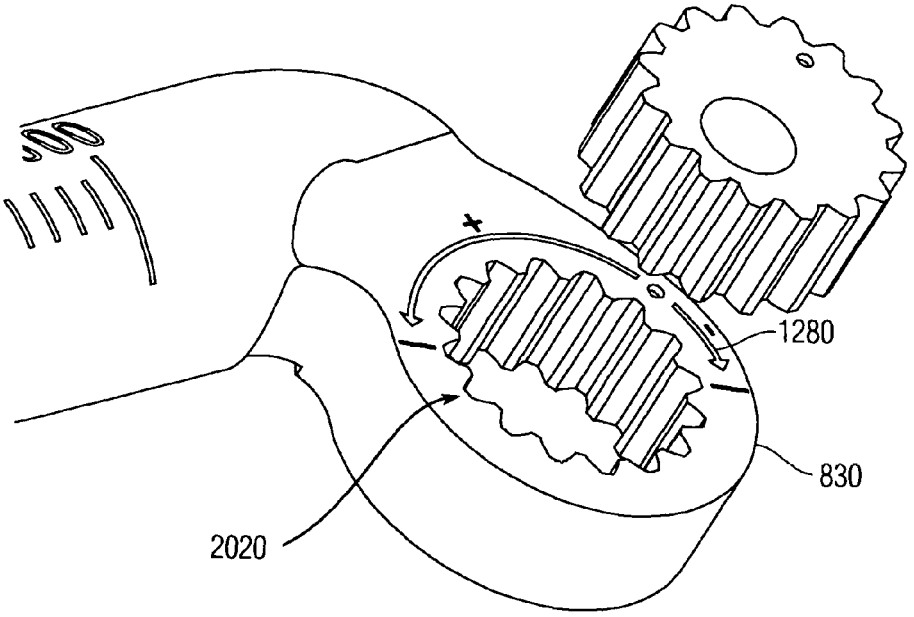

FIGS. 19A and 19B show plan and perspective assembly views 1900 of the right end assembly 1210 at right joint 340 for the second exemplary traverse bar 260 with the sprocket 1220. FIGS. 20A and 20B show perspective exploded views 2000 of the right end 820 with the sprocket 1220 disposed beyond the corresponding cavity 850. Outer splines 2010 along the rim of the sprocket 1220 correspond to tooth serrations 2020 through the cavity 850 into which the sprocket 1220 can be inserted at various angles to align the orifice 1230 to a desired configuration.

Exemplary embodiments provide a curved traverse bar 260 that enables the machine gun (shown in U.S. Pat. No. 9,518,795) to remain level while sweeping from one side to the other. With a conventional straight traverse bar 160, the weapon traces a shallow elevation arc while rotating from side to side. View 200 shows the exemplary design with an exemplary curved traverse bar 260. Due to the chaotic nature of a machine gun mount deployment under combat conditions, high tolerance parts should be minimized. The tripod 210 can loosen after repeated operation, causing joint connections to slacken. Both of these problems have been previously and conventionally mitigated by incorporating an adjustment mechanism to lengthen or shorten the conventional straight traverse bar 160. On the conventional M122 tripod, an end screw was threaded into the traverse bar 160 for connection to the slider on the associated rear leg 140. This screw could be tightened to shorten the traverse bar 160 or loosened to lengthen the traverse bar 160 and secured in place with a lock nut.

This technique to adjust leg separation suffers deficiencies for an exemplary curved traverse bar 260. Drilling a tapped hole for the end screw necessitates a straight bar. Because of the curvature in the exemplary traverse bar 260, this technique cannot be so not easily accommodated. An early attempt at solving this problem with the first exemplary traverse bar 710 switched the adjustment mechanism to the slider with a fixed fork on the ends 720 and 730. An evaluation test determined that this configuration was insufficiently robust to fulfill operational needs. The adjustable nut was not locked securely enough in place and was constantly battered back and forth during firing. This caused the structural material to yield in some sections. Also, opinions were expressed that the design was overly complicated.

The view 900 of the traverse bar 260 shows the stop clamp 270, while view 800 illustrates the traverse bar 260 in isolation. The traverse bar 260 features an elongated member 870 with graduations 810 marked thereon, terminating on the starboard leg 240 at the right joint 340 with the adjustable sprocket 1230 (or 1130), and on the port leg 250 at the left joint 350. The right and left joints 340 and 350 disconnect and slide in their corresponding directions 360 along their respective starboard and port legs 240 and 250 to fold the exemplary tripod 210 in converging directions 370. The right end 820 includes the serrated cavity 850 with annularly arranged teeth 2020, sixteen being shown in this configuration, although this example is not limiting. These cavity teeth 2020 engage the splines 2010 of the sprocket 1220 to fix their relative positions.

The left end 830 has a through-hole 860 that pivots on the left joint 350 of the port leg 250. Both sides of the traverse bar 260 pivot and slide within the rear legs 240 and 250 along their respective joints 340 and 350. Having the connection points slide and pivot enables a more compact shape when closed as well as shorter leg lengths than for a single pivot design. The traverse bar 260 has an exemplary straight-line length from the through-hole 860 of the left end 830 to the center of the sprocket 1120 (or 1220) of 12.297 inches.

The sprocket 1120 can be produced separately from the traverse bar 260, such as by extrusion and slicing perpendicular to its symmetry axis. The offset orifice 1130 enables its relative position in the sprocket 1120 to be altered by pushing the sprocket 1120 out of the cavity 850 turning the sprocket 1120, and then reinserting that back into the cavity 850, as shown in view 1300. By angularly repositioning the cavity 850, the tension between the legs 240 and 250 can be increased in response to fatigue wear loosening the original geometry, thereby necessitating adjustment.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. A tripod for mounting a machine gun between a front pintle and a traverse-and-elevation (T&E) device, said tripod mechanically alterable between stowage and deployment configurations, said tripod comprising:

a head member for receiving the front pintle;

a fore leg connecting to said head member at a fore pitch hinge, said fore leg extending forward in the deployment configuration and folding aft beneath said head member in the stowage configuration;

first and second rear legs connectable to said head member by corresponding rear lateral hinges, each rear leg having a rail member that slides longitudinally thereal-long, said rear legs splaying outward from said head member in the deployment configuration and contracting substantially parallel in the stowage configuration; and a traverse bar that includes an elongated member for mounting the T&E device, first and second termini at opposite ends of said elongated member, and a sprocket, said termini respectively attaching to said first and second legs by respective first and second pivot orifices, and a sprocket, wherein said elongated member has an arc curvature that enables the T&E device to travel along said elongated member with constant elevation of the machine gun, and said first terminus includes a circular serrated cavity for receiving said sprocket having said first pivot orifice, said sprocket being removable to rotate said first pivot orifice for subsequent reinsertion into said serrated cavity, said first pivot orifice being offset from axial center of said sprocket.

2. The tripod according to claim 1, wherein said elongated member includes scale marks for denoting angles for the T&E device.

3. The tripod according to claim 1, wherein said first terminus and said sprocket include scale marks by which to adjust splay between said rear legs.

4. The tripod according to claim 1, wherein said termini traverse with respective slide rails to rotate said traverse bar for folding between said rear legs.

5. The tripod according to claim 1, wherein said second terminal includes said second pivot orifice.

6. A traverse bar for a tripod in which a traverse-and-elevation (T&E) device mounts thereon, said tripod having first and second rear legs, said T&E device adjustably connectable to a machine gun, said traverse bar being installed on said rear legs, said traverse bar comprising:

an elongated member onto which the T&E device mounts, said elongated member having an arc curvature that enables the T&E device to travel along said elongated member with constant elevation of the machine gun;

first and second termini at opposite ends of said elongated member for respectively attaching to the first and second legs by respective first and second pivot orifices, said first terminus including a circular serrated cavity; and a sprocket receivable into said serrated cavity, said sprocket having teeth that engage serrations in said serrated cavity and being removable therefrom to rotate said first pivot orifice for subsequent reinsertion into said serrated cavity, said first pivot orifice being offset from axial center of said sprocket.

7. The traverse bar according to claim 6, wherein said elongated member includes scale marks for denoting angles for the T&E device.

8. The traverse bar according to claim 6, wherein said first terminus and said sprocket include scale marks by which to adjust splay between said rear legs.

9. The traverse bar according to claim 6, wherein said second terminal includes said second pivot orifice.

10. The tripod according to claim 4, wherein said first terminus traverses along a proximal slide rail towards said head member, and said second terminus traverses along a distal slide rail away from said head member.

11. The tripod according to claim 1, wherein angular position insertions for said first pivot orifice of said sprocket within said circular serrated cavity enable length adjustment of said traverse bar.

12. The traverse bar according to claim 6, wherein angular position insertions for said first pivot orifice of said sprocket within said circular serrated cavity enable length adjustment of the traverse bar.

* * * * *